US009944037B2

(12) United States Patent
Murray et al.

(10) Patent No.: US 9,944,037 B2
(45) Date of Patent: Apr. 17, 2018

(54) APPARATUS FOR SIMULTANEOUSLY SEPARATING A PLURALITY OF POUCHES, TRANSFERRING THE POUCHES AND METHOD OF SAME

(75) Inventors: R. Charles Murray, Sarasota, FL (US); Olaf Clemens, Wipperfurth (DE)

(73) Assignee: Pouch Pac Innovations, LLC, Sarasota, FL (US)

( * ) Notice: Subject to any disclaimer, the term of this patent is extended or adjusted under 35 U.S.C. 154(b) by 1195 days.

(21) Appl. No.: 13/471,258

(22) Filed: May 14, 2012

(65) Prior Publication Data

US 2012/0289391 A1 Nov. 15, 2012

Related U.S. Application Data

(60) Provisional application No. 61/485,529, filed on May 12, 2011.

(51) Int. Cl.
*B31B 1/14* (2006.01)
*B31B 50/00* (2017.01)
(Continued)

(52) U.S. Cl.
CPC ..... *B31B 50/00* (2017.08); *B31B 70/006* (2017.08); *B31B 70/14* (2017.08); *B31B 70/94* (2017.08);
(Continued)

(58) Field of Classification Search
CPC ..... B65B 43/18; B65B 43/46; B65B 43/465; B65B 43/123; B65B 61/04; B65B 61/10; B65B 61/06; B65B 51/26; B65B 51/14; B65B 9/08; B65B 1/02; B65B 43/42; B65H 2301/323; B65H 20/00; B65H 20/02; B65H 20/16; B65H 21/00; B65H 21/02; B65H 29/02; B65H 29/10; B65H 20/18; B65H 1/02; B65H 35/06; B65H 29/04; B65H 29/045; B65H 35/00; B31B 1/14; B31B 19/14; B31B 19/16; B31B 19/92; B31B 50/00; B31B 19/06; B31B 70/14; B31B 70/94; B31B 2160/10; B31B 2155/00; B31B 2155/0014; B65G 17/323;
(Continued)

(56) References Cited

U.S. PATENT DOCUMENTS 1,938,325 A * 12/1933 English et al. ..... 271/73
2,061,437 A * 11/1936 Potdevin ..... 493/235
(Continued)

*Primary Examiner* — Nathaniel Chukwurah
*Assistant Examiner* — Eduardo R Ferrero
(74) *Attorney, Agent, or Firm* — Dinsmore & Shohl LLP

(57) ABSTRACT

An apparatus for simultaneously separating a portion of a continuous web of film, having a leading edge and a plurality of spaced apart side seals, includes a base, a plurality of blade pairs, and a film guide device. The blade pairs are moveable between an open and closed positions and are mounted to the base and spaced apart a distance corresponding to the side seals in the film. The film guide device includes a guide member that releasable attaches to a portion of the film adjacent the leading edge. The guide members suspends the film between the plurality of blade pairs in the open position to align the plurality of seals on the film with the plurality of spaced apart blade pairs to accurate separate the film into a plurality of pouches upon movement of the blade pairs to the closed position.

18 Claims, 7 Drawing Sheets

(51) Int. Cl.

| | |
|---|---|
| *B65H 20/16* | (2006.01) |
| *B65B 43/42* | (2006.01) |
| *B65B 43/46* | (2006.01) |
| *B65B 9/08* | (2012.01) |
| *B65B 1/02* | (2006.01) |
| *B65H 20/18* | (2006.01) |
| *B31B 160/10* | (2017.01) |
| *B31B 70/14* | (2017.01) |
| *B31B 70/94* | (2017.01) |
| *B31B 155/00* | (2017.01) |
| *B31B 70/00* | (2017.01) |

(52) U.S. Cl.

CPC ... *B31B 2155/00* (2017.08); *B31B 2155/0014* (2017.08); *B31B 2160/10* (2017.08); *B65B 1/02* (2013.01); *B65B 9/08* (2013.01); *B65B 43/42* (2013.01); *B65B 43/46* (2013.01); *B65B 43/465* (2013.01); *B65H 20/16* (2013.01); *B65H 20/18* (2013.01); *B65H 2301/323* (2013.01)

(58) Field of Classification Search

CPC . B26D 1/02; B26D 1/085; B26D 1/12; B26D 1/151; B26D 1/305; B26D 2001/0066

USPC ..... 493/227, 194–197, 199, 201, 202, 243, 493/231, 254, 256, 356, 200; 383/37; 83/52, 42; 271/293, 73, 82; 53/456, 459

See application file for complete search history.

(56) References Cited

U.S. PATENT DOCUMENTS 2,444,685 A * 7/1948 Waters ..... 493/196
3,009,851 A * 11/1961 Madsen ..... 156/159
3,028,796 A * 4/1962 Neuendorf et al. ..... 493/202
3,130,105 A * 4/1964 Roston ..... 156/359
3,177,746 A * 4/1965 Langer ..... B65H 20/16 83/151
3,408,245 A * 10/1968 Beason ..... 156/515
3,537,225 A * 11/1970 Fields ..... 53/410
3,568,556 A * 3/1971 Gesell et al. ..... 83/355
3,654,841 A * 4/1972 Davis, Jr. ..... 493/190
3,809,389 A * 5/1974 Wirz ..... B65H 3/0816 271/243
3,822,168 A * 7/1974 Wech ..... 56/515
3,851,751 A * 12/1974 Jones ..... B65B 43/30 198/803.5
4,015,515 A * 4/1977 Johnson ..... 493/217
4,056,025 A * 11/1977 Rubel ..... B26D 5/20 83/261
4,212,217 A * 7/1980 Heppner ..... B65H 35/002 83/277
4,255,225 A * 3/1981 Evers ..... 156/515
4,330,288 A * 5/1982 Russell et al. ..... 493/197
4,352,669 A * 10/1982 Norton ..... 493/213
4,353,198 A * 10/1982 Koppe ..... B65B 1/02 53/284.7
4,398,441 A * 8/1983 Jue ..... B26D 1/305 83/575
4,509,313 A * 4/1985 Koppe ..... B65B 1/02 53/570
4,510,841 A * 4/1985 Farran ..... B26D 1/305 83/176
4,617,785 A * 10/1986 Chikatani ..... B65B 43/34 53/562
4,766,810 A * 8/1988 Alt ..... B41F 13/46 101/217
4,776,150 A * 10/1988 Siegel ..... 53/329.3
4,826,476 A * 5/1989 Achelpohl ..... 493/204
4,906,228 A * 3/1990 Reifenhauser et al. ..... 493/196
4,954,124 A * 9/1990 Erickson et al. ..... 493/195
4,982,636 A * 1/1991 Becking ..... B26D 1/165 83/167
4,990,080 A * 2/1991 Kakimoto ..... 425/290
5,058,364 A * 10/1991 Seiden ..... B65B 43/04 53/385.1
5,147,272 A * 9/1992 Richison et al. ..... 493/195
5,177,992 A * 1/1993 Aoki ..... B21D 43/11 226/158
5,279,098 A * 1/1994 Fukuda ..... B29C 66/93451 53/374.6
5,447,486 A * 9/1995 Anderson et al. ..... 493/11
5,830,118 A * 11/1998 Nicholson ..... 493/196
5,845,466 A * 12/1998 Laudenberg ..... B65B 43/465 53/384.1
5,852,917 A * 12/1998 Romagnoli ..... 53/479
5,862,653 A * 1/1999 Solano ..... B65B 1/02 53/284.7
5,911,807 A * 6/1999 Brooks ..... B26D 1/305 83/236
5,957,597 A * 9/1999 Kato ..... B26D 1/305 400/621
5,975,280 A * 11/1999 Cote et al. ..... 198/474.1
5,980,671 A * 11/1999 Delebassee ..... B41F 16/02 156/157
6,030,135 A * 2/2000 Imai ..... B26D 1/305 400/615.2
6,047,528 A * 4/2000 Scholin et al. ..... 53/455
6,186,933 B1 * 2/2001 Dematteis ..... B29C 65/004 493/193
6,199,351 B1 * 3/2001 Mount ..... B65B 1/02 53/386.1
6,212,859 B1 * 4/2001 Bielik et al. ..... 53/455
6,254,092 B1 * 7/2001 Yraceburu ..... B41J 11/007 271/197
6,289,961 B1 * 9/2001 Bausch et al. ..... 156/498
6,357,574 B1 * 3/2002 Eberle et al. ..... 198/465.4
6,425,847 B1 * 7/2002 Broenstrup ..... 493/231
6,605,178 B1 * 8/2003 Shinohara et al. ..... 156/379.6
6,672,705 B2 * 1/2004 Kitahara ..... B41J 2/155 347/19
6,672,720 B2 * 1/2004 Smith ..... B41J 11/0085 271/197
6,675,681 B1 * 1/2004 Beyrich et al. ..... 83/40
6,829,873 B2 * 12/2004 Kinigakis ..... B29C 65/08 53/133.4
7,422,132 B2 * 9/2008 Laitio ..... B65H 20/10 226/19
7,584,593 B2 * 9/2009 Murray ..... B65B 43/30 493/309
7,625,465 B2 * 12/2009 Pesch ..... B65H 20/10 162/193
7,699,765 B2 * 4/2010 Biese et al. ..... 493/21
7,722,517 B2 * 5/2010 Chen ..... 493/208
7,770,362 B2 * 8/2010 Koehn ..... 53/459
7,963,898 B2 * 6/2011 Tan ..... 493/194
2001/0001374 A1 * 5/2001 Guzowski ..... 83/257
2001/0009089 A1 * 7/2001 Todd et al. ..... 53/64
2001/0037712 A1 * 11/2001 Furuhata ..... B26B 13/06 83/694
2002/0117380 A1 * 8/2002 Downs et al. ..... 198/750.11
2002/0183181 A1 * 12/2002 Hayashi et al. ..... 493/194
2003/0073557 A1 * 4/2003 Totani ..... 493/199
2003/0075853 A1 * 4/2003 Hansch ..... 270/52.17
2003/0098219 A1 * 5/2003 Mader et al. ..... 198/678.1
2003/0170110 A1 * 9/2003 Muller ..... 414/788.1
2004/0014577 A1 * 1/2004 Hiramoto ..... 493/197
2004/0139834 A1 * 7/2004 Weiler ..... 83/171
2005/0127554 A1 * 6/2005 Smith ..... 264/138
2005/0281646 A1 * 12/2005 Knuppel ..... B65G 47/915 414/408
2007/0089377 A1 * 4/2007 Yasuhira ..... 53/403
2007/0204570 A1 * 9/2007 Okazaki ..... 53/459
2007/0241151 A1 * 10/2007 Murray ..... 224/407
2008/0069622 A1 * 3/2008 Sodeyama ..... B26D 1/305 400/621
2008/0152472 A1 * 6/2008 Wild et al. ..... 414/739
2008/0250908 A1 * 10/2008 Totani ..... 83/76

(56) References Cited

U.S. PATENT DOCUMENTS

| | | | | |
|---|---|---|---|---|
| 2008/0313998 | A1* | 12/2008 | Ligon | B65B 3/02 53/455 |
| 2009/0241487 | A1* | 10/2009 | Actis | 53/563 |
| 2009/0272630 | A1* | 11/2009 | Mader et al. | 198/803.3 |
| 2009/0320958 | A1* | 12/2009 | Matheyka | 141/98 |
| 2010/0101588 | A1* | 4/2010 | Boldrini et al. | 131/58 |
| 2010/0221055 | A1* | 9/2010 | Shirotori | B26D 1/085 400/621 |
| 2011/0174130 | A1* | 7/2011 | Zhang | B26D 1/12 83/602 |

* cited by examiner

APPARATUS FOR SIMULTANEOUSLY SEPARATING A PLURALITY OF POUCHES, TRANSFERRING THE POUCHES AND METHOD OF SAME

CROSS-REFERENCE TO RELATED APPLICATIONS

This application claims priority of U.S. Provisional Patent Application Ser. No. 61/485,529 filed May 12, 2011, which is incorporated herein by reference in the entirety.

FIELD OF THE INVENTION

The invention relates to an apparatus for forming, filling, and sealing flexible pouches. More particularly, the invention is directed to a pouch forming apparatus operable to simultaneously separate a plurality of pouches and transfer the plurality of pouches into a multi-pouch fill-seal machine.

BACKGROUND OF THE INVENTION

Flexible pouches are used to package a variety of products and are often formed of a roll of continuous web of flexible film material, such as plastic, laminate, or foil. The flexible pouches are typically sealed along the side edges prior to the separation of the flexible film into individual separate pouches. In order to increase the production of finished pouches it is often advantageous to increase the number of pouches undergoing an operation (filling or sealing) at one time. However, the increase in number of pouches operated on often results in a decrease in quality due to the improper placement of each individual pouch into the fill-seal portion of the machine. Also, during the separation of the pouches it is difficult to extend the pouch material the required distance to cut the several pouches. This problem is particularly troublesome when dealing with a thin gauge pouch material.

As the flexible film is preprinted with information, such as mages and text describing the product to be contained therein, any inaccuracies in the separation of the film into the individual pouches results in a defective pouch. As such, it is important that the flexible film be accurately positioned with respect to the side seals that delineate the film into separate pouches.

Accordingly, there exists a need for an apparatus capable of accurately and simultaneously separating a continuous film having a plurality of side seals into a plurality of individual pouches, and an apparatus for simultaneously transferring the plurality of separated pouches into a multi-pouch fill seal machine.

SUMMARY OF THE INVENTION

The present invention provides an apparatus for forming a flexible pouch from a continuous web of flexible film, which overcomes the above-mentioned disadvantages of the previously known machines by simultaneously separating the film into a plurality pouches and transferring the plurality of pouches into a multi-pouch fill seal machine.

In brief, the apparatus is provided for simultaneously separating a portion of a continuous web of film into a plurality of pouches. The continuous web of film having a leading edge and a plurality of spaced apart side seals. The apparatus includes a base, a plurality of blade pairs, and a film guide device. The plurality of blade pairs are mounted to the base and spaced apart a distance corresponding to the side seals in the film. The plurality of blade pairs are moveable between an open position and a closed position. The film guide device includes a guide member that releasable attaches to a portion of the film adjacent the leading edge. The guide members suspends the film between the plurality of blade pairs in the open position so as to align the plurality of seals on the film with the plurality of spaced apart blade pairs to accurate separate the film into a plurality of pouches upon movement of the plurality of blade pairs move from the open position to the closed position.

The plurality of spaced apart blade pairs includes a plurality of first blade portions and a plurality of second blade portions. Each of the plurality of second blade portions corresponds to one of the plurality of first blade portions. The plurality of first blade portions are fixed to the base member and the plurality of second blade portions are pivotally mounted to the base member along a first pivot axis. The apparatus further includes a reciprocating mechanism that reciprocatingly pivots the plurality of second blade portions along the first pivot axis between the open position and the closed position.

The reciprocating mechanism includes a pair rocker arms, a connection member, and a reciprocating unit. The pair of rocker arms are pivotally attached to the base member along a second pivot axis. The connection member extending between the pair of rocker arms and connected to each of the plurality of second blade portions. The reciprocating unit reciprocatingly pivots the pair of rocker arms about the second pivot axis to drive the plurality of second blade portions between the open position and the closed position.

In addition, a transfer apparatus is provided to transfer the plurality of pouches simultaneously separated by the separating apparatus to a multi-pouch fill seal machine. The pouches include an upper edge, an opposite lower edge, and a pair of side edges extending between the upper edge and the bottom edge. The transfer apparatus is positioned between the separating apparatus and the multi-pouch fill seal machine.

The transfer apparatus includes a frame, an elongated member, and a plurality of clips. The frame is positioned between the separating apparatus and the fill-seal machine. The elongated member is slidably attached to the frame along a first direction between a first position adjacent the separating apparatus and a second position adjacent the fill-seal machine. The plurality of clips grip the upper edge of the pouches. Each of the plurality of clips are slidably attached to the elongated member in a second direction which is perpendicular to the first direction. The plurality of clips grip the upper edge of the pouches as the separation apparatus separates the pouches and transfers the pouches to the fill-seal machine. The plurality of clips are spaced apart a first distance when the elongated member is in the first position and the plurality of clips move in the second direction as the elongated member moves from the first position to the second position such that the plurality of clips are spaced apart a second distance when the elongated member is in the second position. The second distance being greater than the first distance.

BRIEF DESCRIPTION OF THE DRAWINGS

A better understanding of the present invention will be had upon reference to the following detailed description when read in conjunction with the accompanying drawings wherein like reference characters refer to the like parts throughout the several views and in which.

DETAILED DESCRIPTION OF THE INVENTION

The present invention has utility as an apparatus for simultaneously separating a plurality of pouches from a continuous web of flexible film, which accurately aligns the plurality side seals form in the film with a plurality of blade pairs. By providing a film guide device that suspends the film between the plurality of blade pairs, the film can be accurately positioned for the simultaneous separation of a plurality of pouches.

Figure 1:
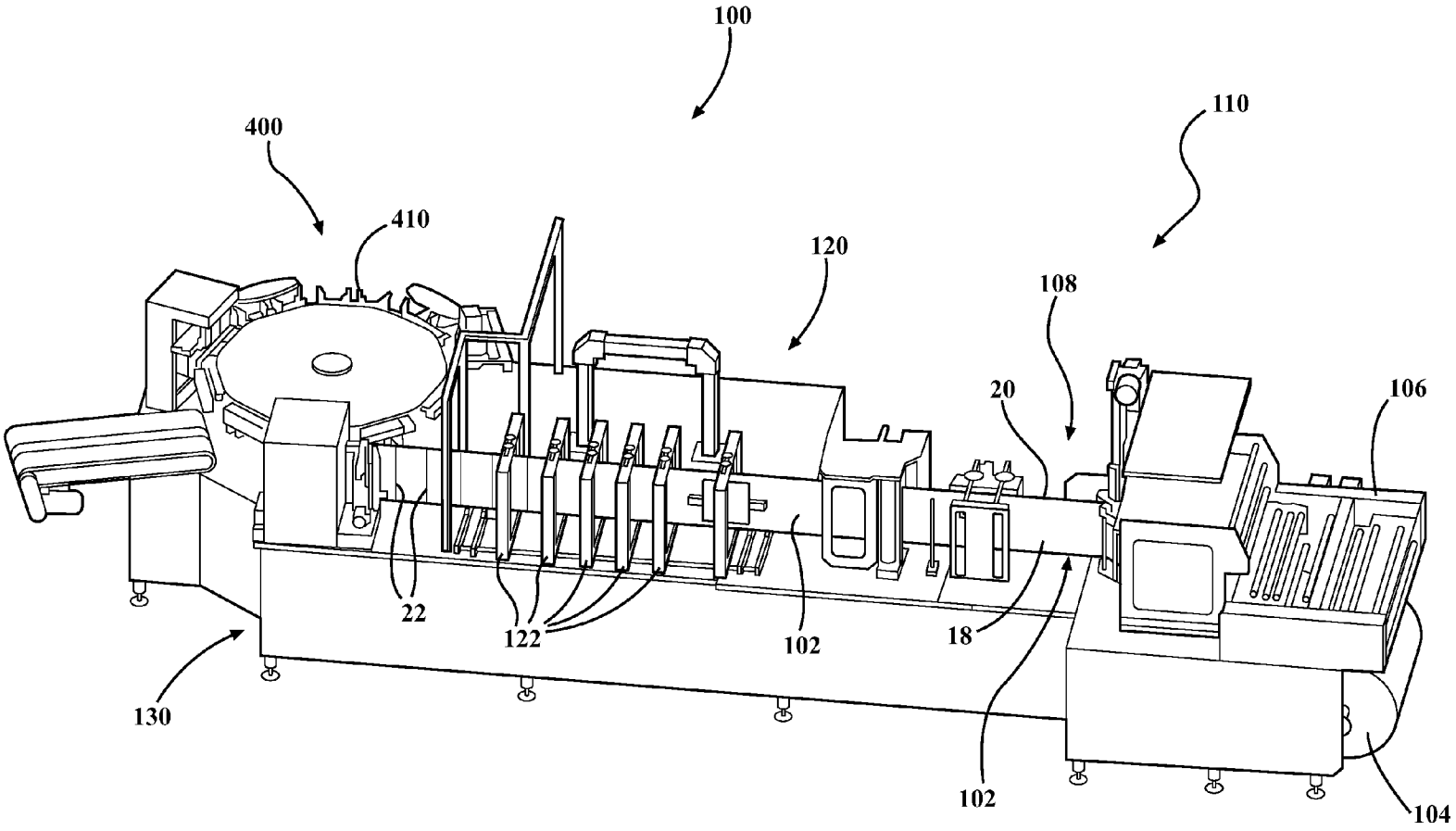
FIG. 1 is a perspective view of the inventive apparatus for forming and separating flexible pouches form a continuous web of flexible film.

With reference to FIG. 1, an apparatus for forming and separating a plurality of flexible pouches is generally illustrated at 100. The apparatus 100 is configured to form a variety of pouches having a variety of different shapes. The flexible pouches are preferably formed from a continuous web of film having a plurality of extruded or laminate layers. The film material is typically a three, or four, or five or more gauge material or multiple laminations of material or the like. The choice of material is non-limiting, and is influenced by factors such as the product contained in the pouch, the shape of the pouch, or the anticipated use of the pouch.

The outer layer of the film is usually preprinted with information including images and text displaying the product to be contained therein. Alternatively, at least a portion of the material may be not printed, i.e. translucent, in order to view the contents contained therein. The clear portion could also be in a gusset or insert. The film is optionally formed of more than one type of material.

As best seen in FIGS. 5A-5D, the pouches 10 include an upper edge 12, and opposite lower edge 14, and a pair of side edges 16. The pair of side edges 16 extend between the upper edge 12 and the lower edge 14. The pouches 10 are formed of the continuous web of film 102 in the pouch forming apparatus 100. The pouches 10 are formed of a front panel 18 and a rear panel 20 that are sealed together along the side edges 16 and the lower edge 14. It is appreciated, of course, that the front panel 18 and the rear panel 20 are formed from a single piece of film or two separate panels sealed together to form the pouch 10. In addition, the flexible pouches 10 may include a variety of additional features including bottom or side gussets, fitments, and resealable zip type openings. The upper edge 12 pouch 10 defines an opening for filling.

As best seen in FIG. 1, the apparatus 100 includes a flexible pouch forming section 110, a multi-pouch sealing section 120, and a multi-pouch separation and transfer section 130. The separation and transfer section 130 includes a separating apparatus 200 that simultaneously separates a plurality of pouches 10 from the continuous web of film 102 and a transfer apparatus 300 that transfers the plurality of separated pouches 10 from the separating apparatus 200 into a multi-pouch fill seal machine 400.

The pouch forming section 110 forms the flexible pouches out of a roll 104 of flexible film material 102. The film 102 is unrolled from the roll 102 and feed into a film driver 106 of the forming section 110. The film driver 106 includes a plurality of horizontally aligned rollers which draw up the flexible film 102 into the apparatus 100. At the exit of the driver 106, the flexible film 102 is folded from a single ply into a dual ply forming a front and rear panel of the pouch.

After or during the folding of the flexible film 102, various features are optionally added at a feature addition section 108. The optionally added features include but are not limited to a reclosable closure such as a zipper fastener, caps, or any other features known to those skilled in the art.

The flexible film 102 proceeds through the feature addition section 108 and into a sealing section 120. At the sealing section 120, a plurality of sealing bars 122 are individually or simultaneously controlled by a motor such as a servo motor. The sealing bars 122 form side seals 22 in the film 102. The sealing bars 122 use heat, pressure, ultrasonics, or any combination thereof in order to form the seal 22. The sealing bars 122 optionally form bottom seals along the lower edge 14 of the pouch 10 or form a gusset seal to seal an inserted gusset to the pouch 10.

The side seals 22 delineate the continuous web of film 102 into a continuous web of pouches each having an area sealed off from the adjacent pouches 10. The sealing bars 122 form the side seals 22 across the height of the film 102 so as to separate the film 102 into individual pouch sections. Although the folded flexible film 104 includes individually defined pouch sections, the pouch sections are still interconnected the film 102 the side seals 22 needs to be cut along the side seals 22 to separate the film 102 into individual pouches 10 and to form the side edges 16 of the pouches 10.

Figure 2:
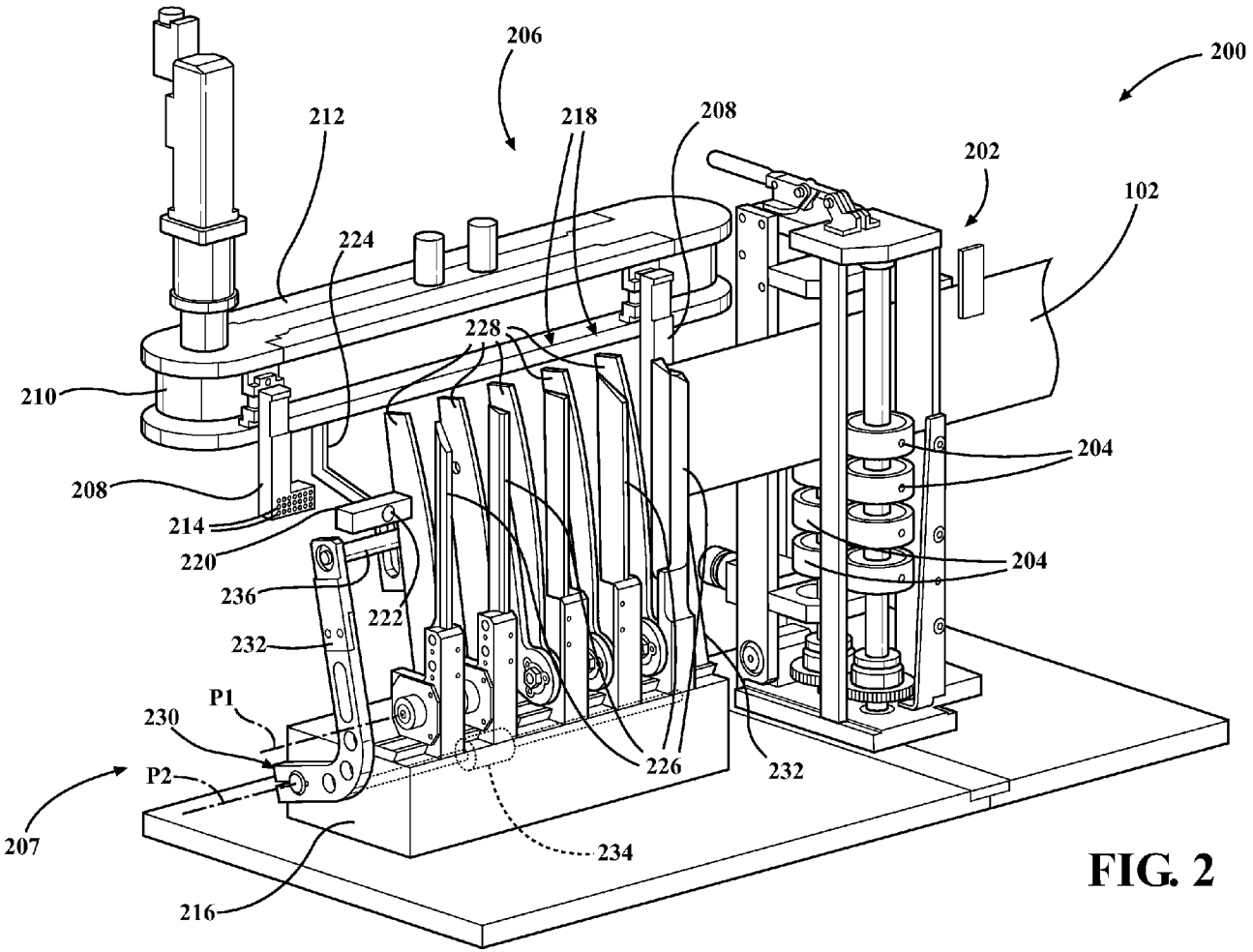
FIG. 2 is a perspective view of separating apparatus.
Figure 3A:
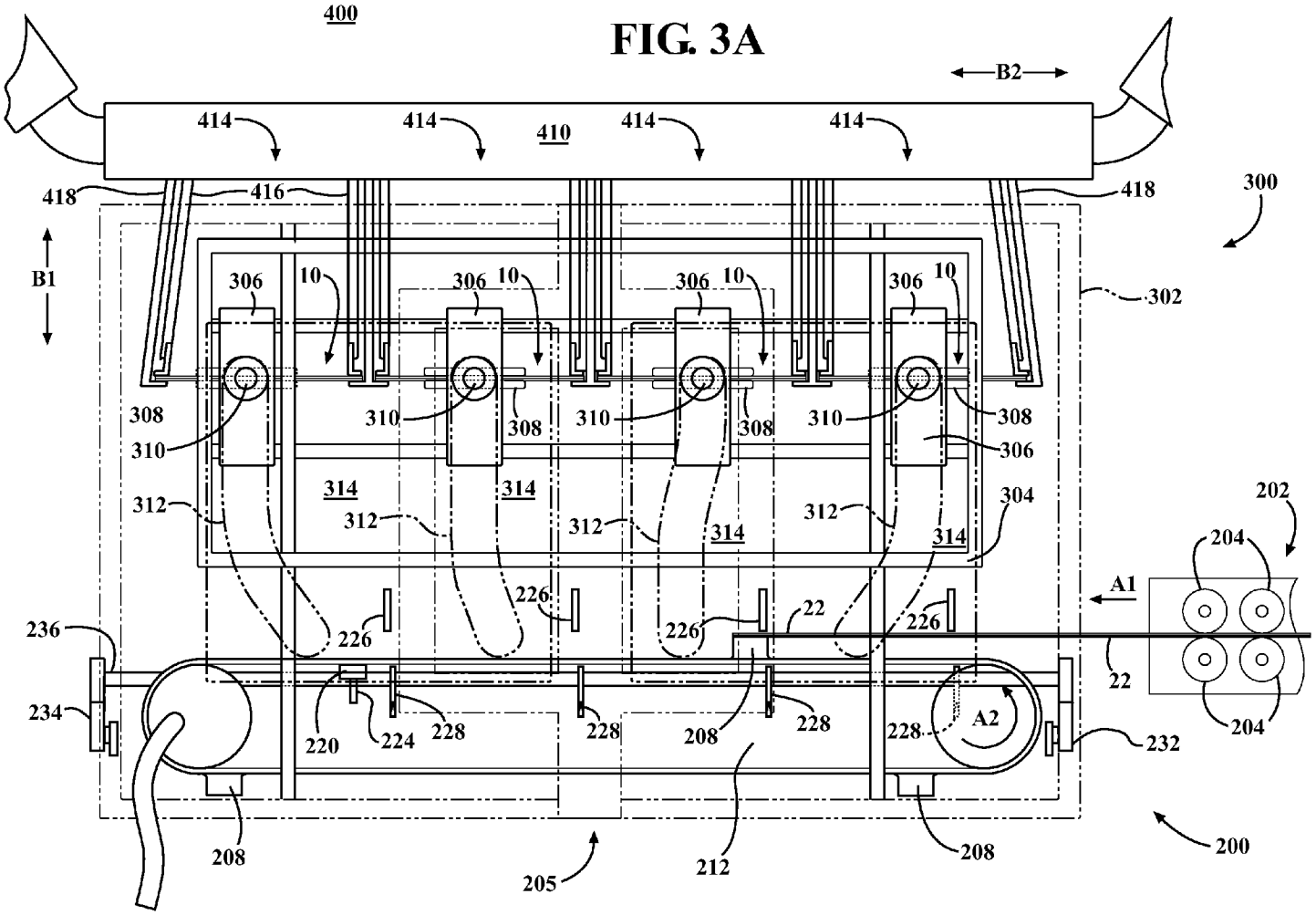
FIG. 3A is a top view illustrating the separation apparatus with the plurality of blade portions in the open position and the transfer apparatus in the second position.
Figure 3B:
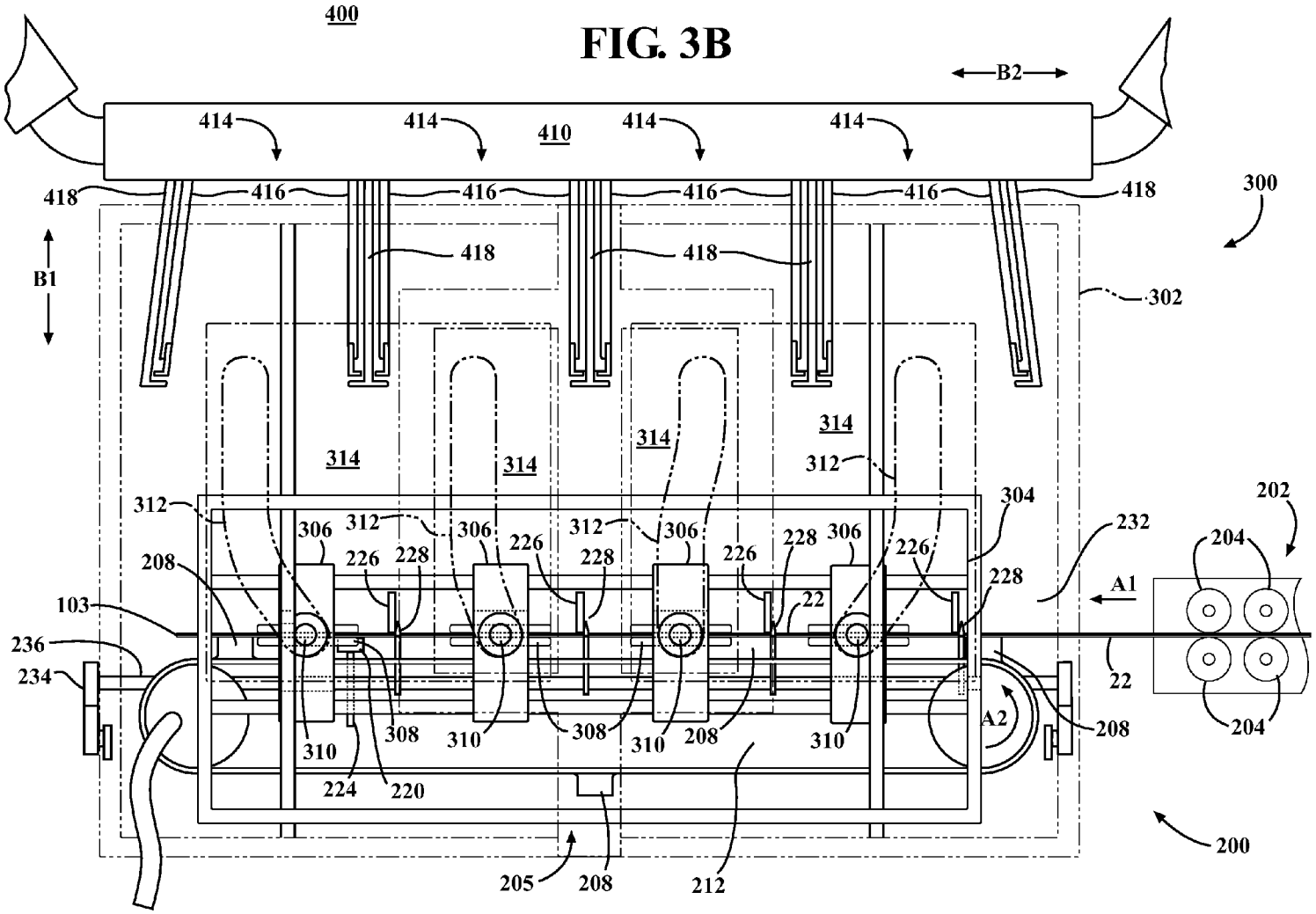
FIG. 3B is a top view illustrating the separation apparatus with the plurality of blade portions in the closed position and the transfer apparatus in the first position.

The film 102, including the individually pouch sections defined by the seals 22 from the sealing bars 122, exits the sealing station 122 and advances to the separation and transfer section 130, specifically, the separating apparatus 200 best seen in FIGS. 2, 3A and 3B. The separating apparatus 200 includes a feed device 202 having a pair of rollers 204. At least one roller 204 is positioned on each side of the film 102. The rollers 204 rotate in opposite directions so as to feed or pull the film 102 into the separating apparatus 200.

In order to extend the film 102 across the length of the separating apparatus 200 while providing sufficient support and height placement to avoid the film 102 from drooping or otherwise falling out of alignment, the separating apparatus 200 includes a film guide device 206 that supports the film 103 as the leading edge 103 extends across a cutting device 207. The film guide device 206 includes a plurality of guide members 208 connected to a belt 210. The belt 210 is rotatable about an outer peripheral of a track support 212. Each of the guide members 208 includes a plurality of holes 214 that operate as a suction cup or device having a vacuum, such that the guide members 208 have a suction effect upon contact with the film 102 so as to suspend and pull the film 102.

The film cutting section 207 includes a base 216 upon which a plurality of blade pairs 218 are mounted. The pairs of blade pairs 218 are moveable between an open position as best seen in FIGS. 2 and 3A and a closed position as best in FIG. 3B. As the film 102 is feed into the separating apparatus 200 by the feed device 202, one of the rotating guide members 208 contacts and due to the suction effect holds on to the leading edge 103 of the film 103. As the guide member 208 rotates due to the belt 210 rotating about the track support 212, the guide member 208 suspends and supports the leading edge of the film 102 as the film 102 is pulled between the plurality of blade pairs 218 in the open position. The guide members 208 are spaced apart on the belt 210 a predetermined distance such as one of the guide members 208 rotates out of engagement with the leading edge 103 of the film 102 after suspending and pulling the film 102 across the cutting station 207 and aligning the seals 22 with the blade pairs 218, another guide member rotates into engagement with a portion of the film 102 that forms a new leading edge 103 due to the separation of the film 102 into individual pouches 10 by the movement of the blade pairs 218 from the open position to the closed position. The plurality of guide members 208 allows for the continuous cycling of film 102 into the separating apparatus 200 thereby decreasing lag between separation of the film 102 into individual pocus 10.

The film support device 205 further includes at secondary film guide 220 positioned on a side opposite the side from the film driver 208. The secondary film guide 220 includes at least one aperture 222 that is connected to the vacuum device such that the secondary film guide 220 functions as a suction device similarly to the film guide member 208. The secondary film guide 220 is attached to moveable shaft 224 connected to the track support 212, and is moveable between a retraced position as best seen in FIG. 3A and an extended position as best seen in FIG. 3B. The secondary film guide 220 provides additional support for the film 102 once the film 102 has been suspended and pulled to an extended most position to accurately position the height of the film 102 and align the seals 22 with respect to the blade pairs 218, as best seen in FIG. 3B.

As such, the film guide device 206 provides sufficient stabilization and support in both the length and height direction of the film 102 during separation. In the alternative, the film guide member 208 and the secondary film guide 220 utilizes clamps or pinches rather than the negative pressure in the form of a suction cup or vacuum to steady the film 102 is feed across the separating apparatus 200.

The plurality of blade pairs 218 each includes a first blade portion 226 and a corresponding second blade portion 228. The first blade portions 226 and the second blade portions 228 operated to slice, shear, or otherwise cut the seals 22 formed in the film 102 to separate continuous web of pouch sections into individual pouches 10. The first blade portions 226 are positioned on one side of the film 102 and the second blade portions 228 are positioned on the other side of the film 102. The first blade portions 226 are secured to the base 216 and the second blade portions 228 are pivotally mounted to the base 216 about a first pivot axis P1 such that the plurality of blade pairs 218 are moveable between an open position and a closed position upon pivoting of the second blade portions 228 about the pivot axis P1.

The cutting section 207 includes a reciprocating mechanism 230 that reciprocatingly moves the blade pairs 218 between the open position and the closed position. The reciprocating mechanism 230 includes a pair of rocker arms 232 positioned on either side of the blade pairs 218. The rocker arms 232 are attached to a reciprocating unit 234 that reciprocatingly pivots the rocker arms 232 about a second pivot axis P2 which is parallel and spaced apart from the first pivot axis P1. The reciprocating unit 234 is optionally an electronically controlled servo motor or a reciprocating mechanical mechanism.

A connection rod 236 acting as a connection member extends between the pair of rocker arms 232. The connection rod 236 being attached to each of the second blade portions 228 to transmit the reciprocating pivoting of the rocker arms 232 about pivot axis P2 to reciprocatingly pivot second blade portions 228 about the second pivot axis P2 to reciprocatingly move the blade pairs 218 between the open position and the closed position.

As best seen in FIGS. 3A and 3B, the transfer apparatus 300 is positioned between the separating apparatus 200 and the multi-pouch fill seal machine 400. Specifically a loading station of the multi-pouch fill seal machine 400. It is appreciated, of course, that the transfer apparatus mechanism 300 is configured to transfer a corresponding number of pouches 10 separated by the separating apparatus 200 into the load station of the fill seal machine 400. As will be described in greater detail below, the load station includes a gripper mechanism 410 having a plurality of gripper arm pairs 414 which corresponds to the number of pouches simultaneously separated by the separating apparatus 200 and transferred by the transfer apparatus 300. Accordingly, the separating apparatus 200, the transfer apparatus 300, and the fill seal machine 400 are multi-pouch operable illustratively including single, dual, triple, quadruple, and quintuple simultaneous pouch separation, transfer and fill-seal.

The transfer apparatus 300 includes a frame member 302 that is positioned between the separating apparatus 200 and the gripper mechanism 410 of the fill seal machine 400. The frame is suspended above the gripper mechanism 410. An elongated member 304 is slidably attached to the frame 302 for reciprocating movement along a first direction B1. The elongated member 304 is moveable between a first or pick up position as best seen in FIG. 3B and a second or deposit position as best seen in FIG. 3A. The elongated member 304 is optionally attached to the frame 302 using a plurality of rollers (not shown). The rollers allow the elongated member 304 to be pulled, pushed or otherwise operated on for movement in the first direction. The movement of the elongated member 304 is optionally controlled by an electronically controlled servo motor, a pulley system, or a reciprocating mechanical mechanism.

The transfer apparatus 300 includes a plurality of holders 306 each having a clip 308 attached to a bottom end for gripping the upper edge 12 of the pouch 10. Each of the holders 306 are slidingly attached to the elongated member 304 for movement along a second direction B2 which is perpendicular to the first direction B1. As discussed in greater detail below, the clips 308 are operable to attach to the film 102 between the seals 22 i.e. the upper edges 12 of the pouches 10, prior to the separation of the film 102. As best seen in FIGS. 3A and 3B, each of the clips 308 includes a pair of elongated fingers which pinch the upper edge 12 of the pouch 10 to the hold the pouch 10 during transferring between the separating apparatus 200 and the gripper mechanism 410. In the alternative, the holders 306 utilize suction or vacuum cups that attach to the pouches 10 or film 102 through the use of negative pressure.

The clips 308 are optionally electronically controlled to open upon the elongated member 304 moving into and out of the first position and second position so as to grip the pouches 10 from the separating apparatus 200 in the first position and deposit the pouches 10 into the gripping mechanism 410 in the second position. Alternatively, the clips 308 are actuated by cams positioned on the frame 302 adjacent the first position and the second position.

The holders 306 include a slide member 310 positioned on an upper side opposite the clips 308. The slide members 310 are configured to engage within guide slots 312 formed in guide plates 314 attached to the frame 302. The guide slots 312 allow for the movement of the holders 306 in the direction of arrow B2 as the elongated member 304 moves in the direction of arrow B1. Specifically, the guide slots 312 allow for the distance between each of the holders 306 to be increased from a first distance when the elongated member 304 is in the first position and a second distance when the elongated member 304 is in the second position as described in greater detail below.

Figure 4:
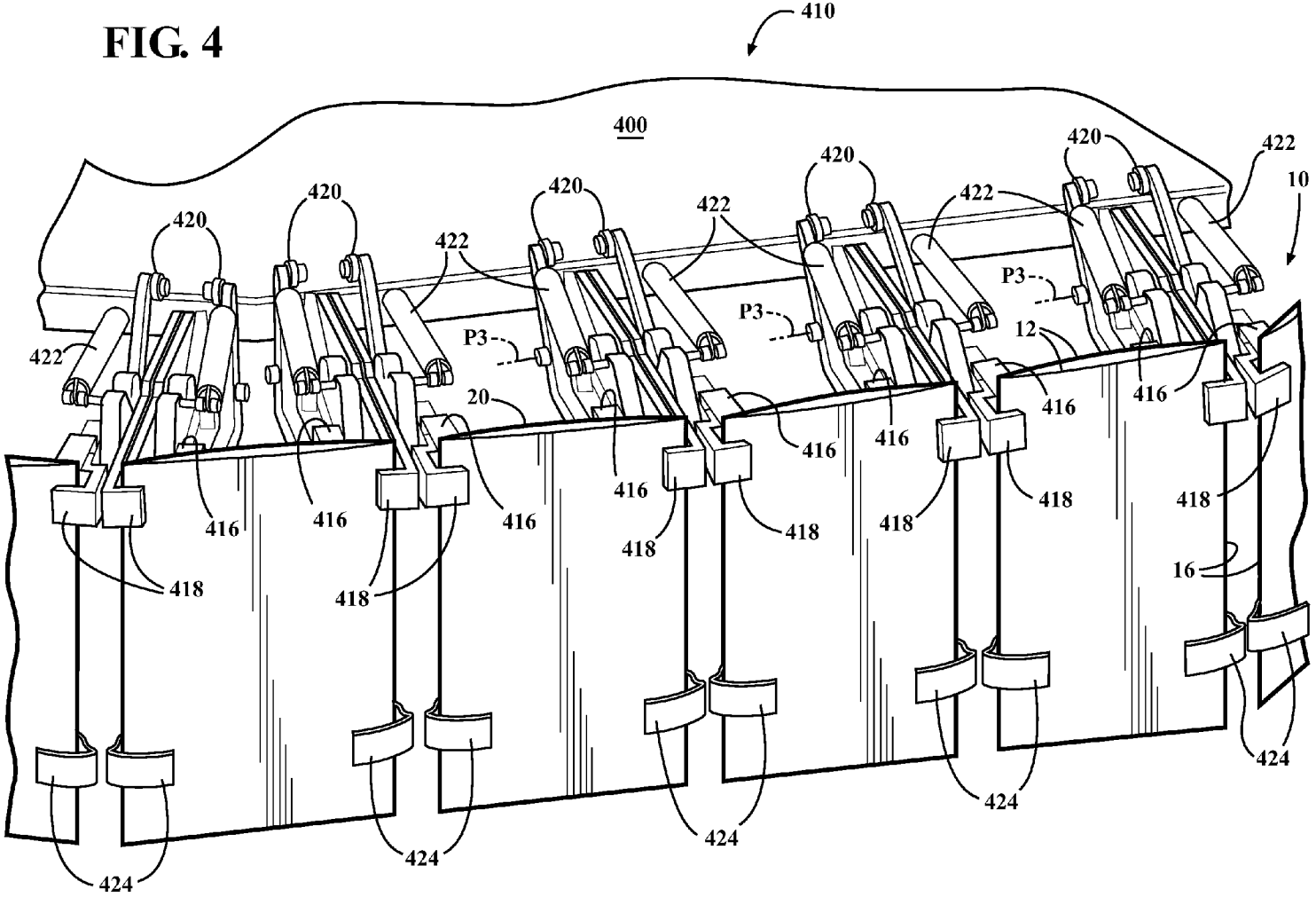
FIG. 4 is a perspective view of the gripper mechanism of the multi-pouch fill seal machine is a top schematic view illustrating a plurality of pouches being loaded into the transfer mechanism.

With reference to FIG. 4, the gripper mechanism 410 of the fill seal machine 400 will now be discussed. The fill seal machine 400 is optionally a rotary or linear multi-pouch fill seal machine which is capable of moving a plurality of pouches 10 through various stations to fill and seal the pouches 10. The fill seal machine 400 includes a gripper mechanism 410 to grip the plurality of pouches 10 as the pouches 10 under go various operations at the various stations. The guide slots 312 extend generally in the first direction between the separating apparatus 200 and the gripper mechanism 410, and optionally have a nonlinear shape so as to gently vary the distance between the holders 306 in the second direction B2.

The gripper mechanism 410 includes the plurality of gripper arm pairs 414 positioned at each side of the pouch 10 to grip the side edges 16 of the pouches 10 a predetermined length L1 from the upper edge 12. The length L1 is of sufficient length so that the gripper arm pairs 414 are spaced apart from the clips 308. The gripper arm pairs 414 grip the side edges 16 of the pouches the predetermined length L1 from the upper edge 12 to avoid interfering with the various operations the pouches 10 undergo in the fill seal machine 400 and to avoid contacting the clips 308 as the pouches 10 are transferred from the separating apparatus 200 to the loading station of the fill seal machine 400. The clips 308 attach to the upper edge 12 of the pouches 10 and extend below the upper edge 14 a second predetermined length which is less than the predetermined length L1.

Figure 5A:
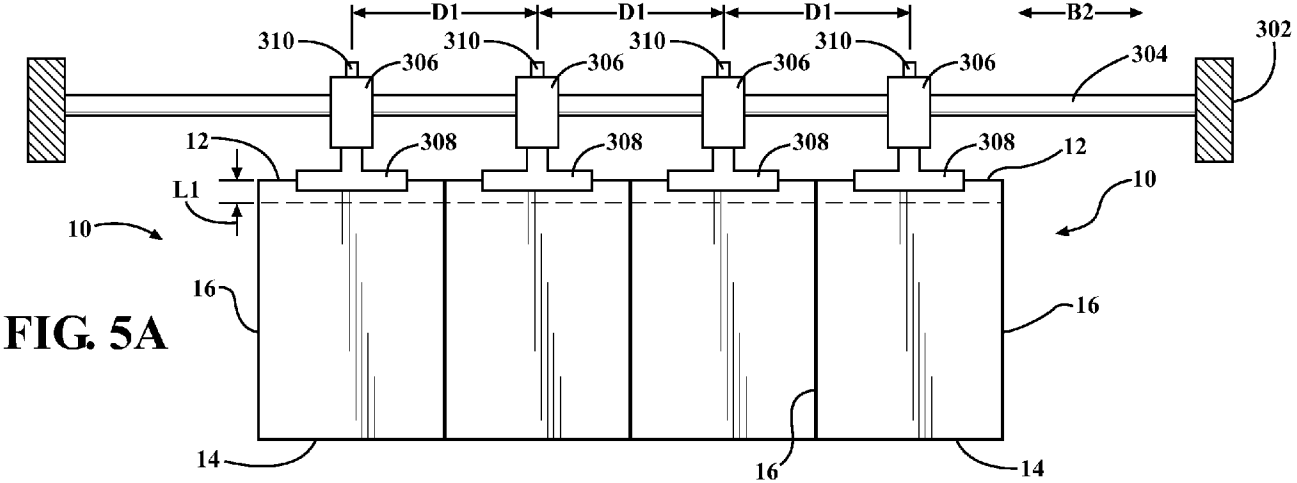
FIG. 5A is a side schematic view illustrating the transfer apparatus in the first position.
Figure 5B:
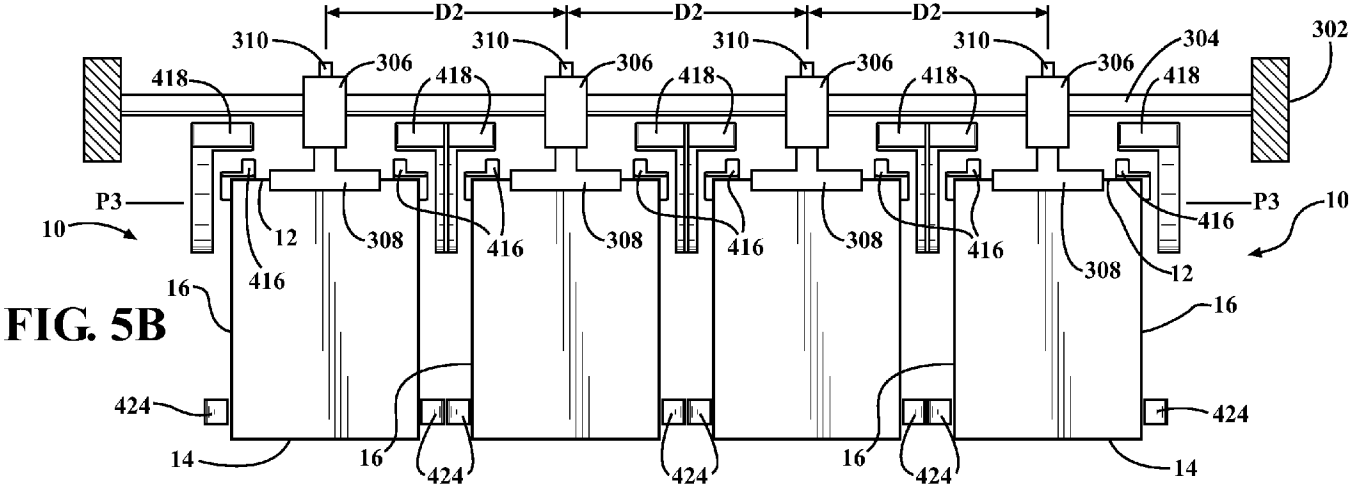
FIG. 5B is a side schematic view illustrating the transfer apparatus in the second position.
Figure 5C:
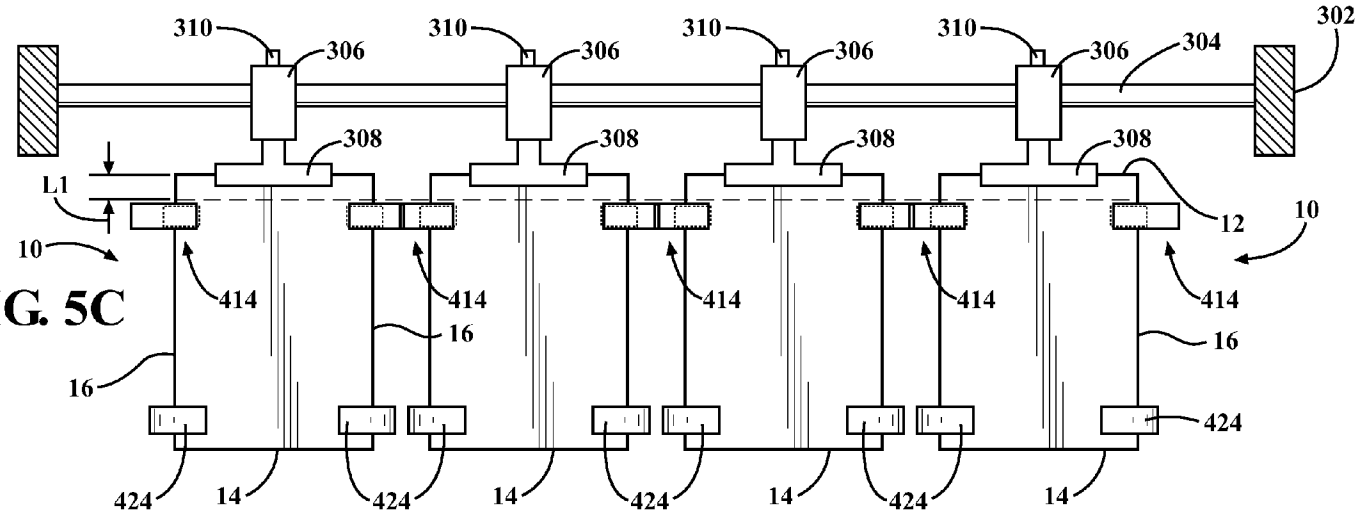
FIG. 5C is a side schematic view illustrating the pouches being held by the transfer apparatus and the gripper mechanism.
Figure 5D:
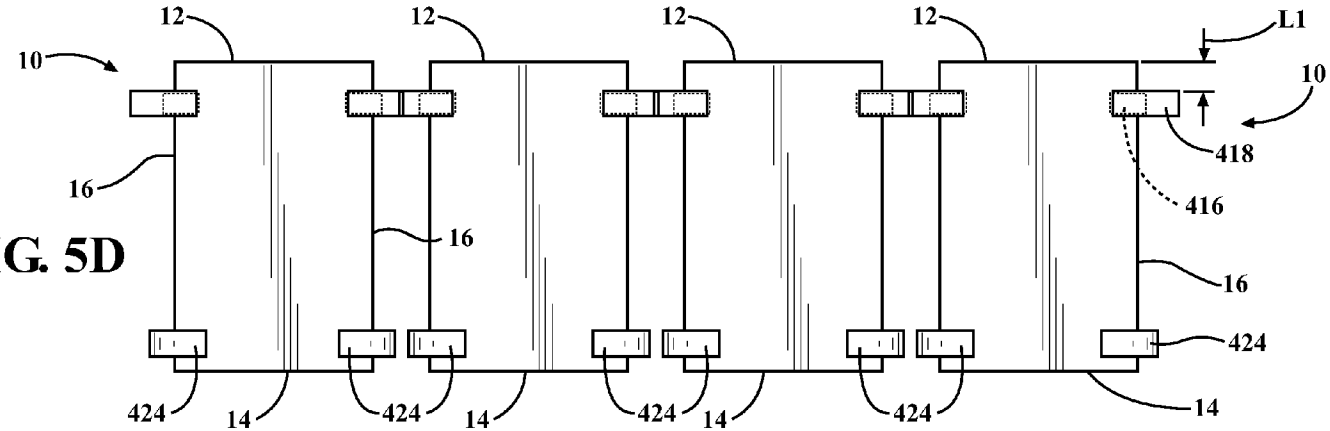
FIG. 5D a side schematic view illustrating gripper mechanism gripping the plurality of pouches.

Each one of the plurality of gripper arm pairs 414 includes an inner arm 416 and an outer arm 418. The outer arms 418 are moveable between a raised position as best seen in FIG. 5B and a closed positioned as best seen in FIGS. 4 and 5C-5D. The outer arms 418 are pivotal about a pivot axis P3 to pivot between the raised position and the closed position. In the raised position, the outer arms 418 are elevated to receive the pouches 10 and in the closed position the outer arms 418 are lowered to grip the pouches 10 between the outer arms 418 and the inner arms 416. The outer arms 418 are actuated by cams 420 such that upon movement of the gripper mechanism 410 into the loading station of the fill seal machine 400, the cams 420 are actuated to elevated the outer arms 418 into the raised position to receive the pouches 10. Once the pouches 10 have been transferred from the separating apparatus 200 to the gripper mechanism 410, the cams 420 are actuated to return the outer arms 418 to the closed position. The gripper arm pairs 414 each include a biasing member 422 that biases the outer arm 418 into the closed position to retain the pouch 10 between the outer arms 418 and the inner arms 416.

The gripper mechanism 410 further includes a plurality of limit arms 424 acting as pouch stabilization devices that prevent the pouches 10 from swaying. The limit arms 424 are offset so that the limit arm 424 of each adjacent pair of limit arms 424 are positioned either above or below the next adjacent pair of limit arms 424. By offsetting the limit arms 424 the gripper mechanism 410 can be made more compact and additional pouches 10 can be gripped. The limit arms 424 are positioned adjacent the lower edge 14 of the pouch and below the gripper arm pairs 414. The limit arms 424 do not grip the side edges 16 of the pouches 10 having generally L shaped arms that receive the side edges 16 within a corner portions such that the limit arms 424 are substantially spaced apart from the front 18 and rear 20 panels. The shape of the limit arms 424 also provides for the limits arms 424 to receive pouches 10 having various widths. Rather, the limit arms 424 merely limit the ability of the pouches to move or sway due to the forces acting on the pouch 10 during fill and sealing operations. Specifically, in a rotary style fill seal machine 400, as illustrated in FIG. 1, the gripper mechanism 410 are rotated through a plurality of stations. At high speeds of rotation the centrifugal forces cause the pouches 10 to sway outwardly which could interfere with the fill and seal operations. The limit arms 424 limit the ability of the pouches 10 from sway. Similar to the gripper arm pairs 414, the limit arms 424 are moveable between an open position and a closed position as best seen in FIG. 5B and FIGS. 5C-5D, respectively.

It is appreciate, of course, that the illustrated gripper mechanism 420 includes depicts four pair of gripper arm pairs 414 and limit arms 424 to grip four pouches, the invention is not limited to such a configuration, and optionally includes dual, triple, or quintuple simultaneous pouch separating (as seen in FIG. 3), transfer and fill-sealing.

In order to facilitate a better understanding of the invention, the operation of simultaneously separating a plurality of pouches and transferring the plurality of pouches to a multi-pouch fill seal machine will now be discussed. With reference to FIG. 3A, the feed device 202 feeds a leading edge 103 of the film 102 towards the separating apparatus 200 in the direction of arrow A1. The guide members 208 are rotating about the peripheral of the track support 212 in the direction of arrow A2. As one of the guide members 208 rotates about the track support 212, one of the guide members 208 contacts and releasably attaches to a portion of the film 102 adjacent the leading edge 103 due to the suction from the holes 214. The guide member 208 continues to rotate with the supported and suspended film 102.

The blade pairs 218 are in the open position with the first blade portions 226 and the second blade portions 228 being spaced apart. As the guide member 208 rotates along one side of the track support 212, the film 102 is pulled the between the spaced apart first blade portions 226 and the second blade portion 228. As the guide member 208 rotates around the distal end of the track support 212, the secondary film guide 220 moves from the retracted position as seen in FIG. 3A to the extended position as seen in FIG. 3B such that as the guide member 208 disengages with the leading edge 103 of the film 102, the secondary film guide supports the film 102 in the height and length direction so as to align the space apart side seals 22 with plurality of spaced apart blade pairs 218.

As the leading edge 103 of the film 102 reaches the secondary film guide 220, the elongated member 304 moves from the second position adjacent the gripper mechanism 410 to the first position adjacent the separating apparatus 200. In the first position the clips 308 grip the upper edge 12 of the film 102 between the side seals 22, as best seen in FIG. 3B, prior to the actuation of the cutting device 207 and while the film 102 is still a continuous web. Once the clips 308 have gripped the film 102, the reciprocating unit 234 actuates to pivot the rocker arms 232 about pivot axis P2. The movement of the rocker arms 234 about pivot axis P2 pivots the second blade portions 228 about the first pivot axis P1 from the open position as seen in FIG. 3A to the closed position as seen in FIG. 3B. The movement of the blade pairs 218 from the open position to the closed position cuts the film 102 along the side seals 22 to simultaneously separate the film 102 into a plurality of individual pouches 10.

Once the blade pairs 218 cut the film 102 into the plurality of pouches 10, the elongated member 304 moves from the first position as best seen in FIG. 3B towards the second position as best seen in FIG. 3A. As the elongated member 304 moves in the direction of arrow B1 towards the second position, the slide members 310 of the holders 306 are guided by the guide slots 312 formed in the guide plates 314. The guide slots 312 guide the slide members 310 to move the holders 306 in the direction of arrow B2 along the elongated member 304. The guide slots 312 guide the holders 306 to slide along the elongated member 304 to vary the distance between the holders 306 from a first distance D1 as seen in FIGS. 3B and 5A to a second distance D2 seen in FIGS. 3A and 5B-5C.

The distance between the holders 306 is varied between D1 in the first position and D2 in the second position as the pouches 10, when cut by the movement of the blade pairs 218, are in abutting contact as the side seals 22 were cut to form the side edges 16. However, the gripper arm pairs 414 of the gripper mechanism 410 are spaced apart and in order to accurately position the pouches 10 within the gripper arm pairs 414 as seen in FIGS. 5B-5D, the distance between the holders 306 must be increased from the distance D1 at the first position adjacent the separating apparatus 200 to distance D2 at the second position adjacent the gripper mechanism 410.

As the elongated member 304 moves into the second position the pouches 10 are positioned to be gripped by the gripper arm pairs 414. Specifically, once the clips 308 are in the second position, the cams 420 are actuated to move the outer arms 418 from the raised position to the closed position to grip the pouches a predetermined length L1 from the upper edge of the pouch 10. In addition, the limit arms 424 are moved from the open position to the closed position to limit the swinging of the pouches 10. Once the pouches 10 have been gripped by the gripper arm pairs 414 the elongated member 304 moves from the second position back towards the first position to transfer the next set of pouches separated by the separating apparatus 200.

As the blade pairs 218 move from the closed position to the open position due to the reciprocating pivoting of the rocker arms 234 due to the movement of the reciprocating unit 234, the secondary film guide 220 is moved from the extended position to the retracted position. The guide members 208 rotate around the support track 212 as the feed device 202 feeds the film 102 towards the separating apparatus 200, thereby repeating the cycle of feeding the film 102, suspending and pulling the leading edge 103 of the film 102 across the cutting device 207, aligning the seals 22 with the blade pairs 218, moving the elongated member 304 from the second position to the first position, gripping the upper edge 12 of the pouches with the clips 308, separating the film 102 into individual pouches 10 by movement of the blade pairs 218 from the open position to the closed position, and transferring the separated pouches 10 into the gripper mechanism 410.

It will be appreciated, of course, that fill seal machine 400 is optionally either a rotary or linear fill seal machine. It is appreciated, of course, that many modifications and variations of the present invention are possible in light of the above teachings and may be practiced other than as specifically described.

It is claimed:

1. An apparatus for simultaneously separating a portion of a continuous web of film into a plurality of pouches, the film having a leading edge and a plurality of spaced apart seals, said apparatus comprising:

a base;

a plurality of spaced apart blade pairs mounted to said base, each of said blade pairs moveable between an open position and a closed position; and a film guide device having a guide member that releasable attaches to an exterior surface of a portion of the film adjacent the leading edge, said guide member passes through said plurality of spaced apart blade pairs in said open position to pull the film through said plurality of blade pairs in said open position so as to align the plurality of seals on the film with said plurality of spaced apart blade pairs to separate the film into a plurality of pouches upon movement of said plurality of blade pairs from said open position to said closed position.

2. The apparatus of claim 1, wherein said film guide device includes a track and said guide member operable to rotate around said track.

3. The apparatus of claim 2, wherein said guide member is a suction cup device that attaches to the film using a vacuum.

4. The apparatus of claim 3, wherein said film guide device includes a plurality of guide members, each of said guide members being attached to said track at a predetermined distance apart.

5. The apparatus of claim 4, wherein said plurality of spaced apart blade pairs includes a plurality of first blade portions and a plurality of second blade portions, each of said plurality of second blade portions corresponding to one of said plurality of first blade portions, and wherein said plurality of first blade portions are fixed to said base member and said plurality of second blade portions are pivotally mounted to said base member along a first pivot axis.

6. The apparatus of claim 5 further comprising a reciprocating mechanism that reciprocatingly pivots said plurality of second blade portions along said first pivot axis between said open position and said closed position.

7. The apparatus of claim 6, wherein said reciprocating mechanism includes a pair rocker arms, a connection member, and a reciprocating unit, said pair of rocker arms being pivotally attached to said base member along a second pivot axis, said connection member extending between said pair of rocker arms and connected to each of said plurality of second blade portions, said reciprocating unit reciprocatingly pivots said pair of rocker arms about said second pivot axis to drive said plurality of second blade portions between said open position and said closed position.

8. The apparatus of claim 7, wherein said second pivot axis is parallel with and spaced apart from said first pivot axis.

9. The apparatus of claim 8, wherein a film driver is positioned on one end of said apparatus, and said film driver having a pair of opposing rollers that receive the film therebeween to drive the film towards said apparatus, and wherein upon exiting the film driver one of said guide members attaches to a portion of the film adjacent the leading edge.

10. The apparatus of claim 9, wherein a secondary suction device is positioned on an end of said apparatus opposite said film driver, said secondary suction device releasable attaches to the leading edge of the film as one of said guide members rotates and disengages from the leading edge of the film, and wherein said secondary suction devices holds the portion of the film adjacent the leading edge in place to align the plurality of seals with said plurality of spaced apart blade pairs.

11. The apparatus of claim 1 further comprising a transfer apparatus positioned between said separating apparatus and a multi-pouch fill seal machine, said transferring apparatus having a frame, an elongated member, and a plurality of clips;

said elongated member slidably attached to said frame, said elongated member moveable in a first direction between a first position adjacent said separating apparatus and a second position adjacent said fill-seal machine in a first direction; and said plurality of clips operable to grip an upper edge of the pouches, each of said plurality of clips being slidably attached to said elongated member in a second direction, said second direction being perpendicular to said first direction, said plurality of clips gripping the upper edge of the pouches as said separation apparatus separates the pouches and transfers the pouches to said fill-seal machine, said plurality of clips spaced apart a first distance when said elongated member is in said first position and said plurality of clips move in said second direction as said elongated member moves from said first position to said second position such that said plurality of clips are spaced apart a second distance when said elongated member is in said second position, said second distance being greater than said first distance.

12. An apparatus for forming a plurality of pouches from a continuous web of film having a leading edge and a plurality of side seals, the pouches having an upper edge, an opposite lower edge, and a pair of side edges extending between the upper top edge and the bottom edge, said apparatus comprising:

a separating apparatus that simultaneously separates a portion of the continuous web of film into the plurality of pouches, the separating apparatus includes a plurality of spaced apart blade pairs moveable between an open position and a closed position;

a film guide device having a guide member that releasably attaches to an exterior surface of a portion of the film adjacent the leading edge, said guide member passes through said plurality of spaced apart blade pairs in said open position to pull the film through said plurality of blade pairs in said open position so as to align the plurality of seals on the film with said plurality of spaced apart blade pairs to separate the film into a plurality of pouches upon movement of said plurality of blade pairs from said open position to said closed position;

a fill-seal machine that fills and seals the plurality of pouches; and a transfer apparatus positioned between said separating apparatus and said fill-seal machine, said transfer apparatus simultaneously transfers the plurality of pouches separated by said separating apparatus to said fill-seal machine.

13. The apparatus of claim 12, wherein said transfer apparatus includes:

a frame positioned between said separating apparatus and said fill-seal machine;

an elongated member slidably attached to said frame, said elongated member moveable in a first direction between a first position adjacent said separating apparatus and a second position adjacent said fill-seal machine; and a plurality of clips for gripping the upper edge of the pouches, each of said plurality of clips being slidably attached to said elongated member in a second direction, said second direction being perpendicular to said first direction, said plurality of clips gripping the upper edge of the pouches as said separation apparatus separates the pouches and transfers the pouches to said fill-seal machine, said plurality of clips spaced apart a first distance when said elongated member is in said first position and said plurality of clips move in said second direction as said elongated member moves from said first position to said second position such that said plurality of clips are spaced apart a second distance when said elongated member is in said second position, said second distance being greater than said first distance.

14. The apparatus of claim 13, wherein each of said plurality of clips includes a slide member positioned on an upper end, and wherein said frame includes plurality of guide slots formed therein, wherein said slide member of each said plurality of clips being positioned in one of said plurality of guide slots such upon movement of said elongated member from said first position to said second position said slide members are guided by said guide slots to increase said distance from said first distance to said second distance.

15. The apparatus of claim 14, wherein said clips grip the upper edge of the pouch between the pair of side edges of the pouch.

16. The apparatus of claim 15, wherein said plurality of said guide slots extend generally horizontally.

17. The apparatus of claim 13, wherein said fill-seal machine includes a plurality of gripper arm pairs and a plurality of pairs of limit arms, said gripper arm pairs and said pairs of limit arms corresponding to the plurality of pouches transferred from said separating apparatus to said fill-seal machine by said transfer apparatus;

said plurality of gripper arm pairs grip the side edges of the pouch a predetermined distance from the upper edge to avoid contact with said plurality of clips gripping the upper edge of the pouch;

said pairs of limit arms positioned below said gripper arm pairs, said pairs of limit arms prevent the pouches from moving due to forces of said fill-seal machine, said limit arms being spaced apart from the pouches when in a closed position.

18. A method for forming a plurality of flexible pouches from a continuous web of flexible film having a leading edge, said method comprising:

forming a plurality of spaced apart side seals in said film to delineate said film into a web of continuous pouches;

providing a separation apparatus having a plurality of spaced apart blade pairs;

providing a film guide device having a guide member that releasably attaches to an exterior surface of a portion of the film adjacent the leading edge;

passing said guide member passes through said plurality of spaced apart blade pairs in said open position to pull the film by the guide member through the plurality of spaced apart blade pairs in an open position;

aligning said plurality of side seals with said plurality of spaced apart blade pairs; and separating said continuous web of pouches into a plurality of individual pouches by moving the plurality of spaced apart blade pairs from said open position to a closed position.

* * * * *